United States Patent [19]

Kidwell

[11] 3,948,061

[45] Apr. 6, 1976

[54] CENTRIFUGAL REFRIGERATION UNIT

[75] Inventor: Johnny Evans Kidwell, Pryor, Okla.

[73] Assignees: George B. Vest, Pryor; Oscar Jones, Salina; James R. Head, Tulsa, all of Okla.

[22] Filed: Oct. 29, 1974

[21] Appl. No.: 518,705

[52] U.S. Cl. ..... 62/499; 165/86

[51] Int. Cl.[2] ..... F25B 3/00

[58] Field of Search ..... 62/499; 165/86

[56] References Cited

UNITED STATES PATENTS

| | | | |
|---|---|---|---|
| 2,811,841 | 11/1957 | Grimshaw | 62/499 X |
| 3,098,602 | 7/1963 | Torluemke | 62/499 X |
| 3,189,262 | 6/1965 | Hanson et al. | 62/499 X |
| 3,397,739 | 8/1968 | Miller | 62/499 X |

FOREIGN PATENTS OR APPLICATIONS

| | | | |
|---|---|---|---|
| 541,575 | 12/1931 | Germany | 62/499 |

*Primary Examiner*—William O'Dea
*Assistant Examiner*—Ronald C. Capossela
*Attorney, Agent, or Firm*—Head, Johnson & Chafin

[57] ABSTRACT

A centrifugal refrigeration unit which comprises a rotatable shaft carrying two spiral tubular assemblies, one on each end. Each assembly comprises two spiral tubes. At one end the assembly acts as a condenser, and at the other end as an evaporator. Means are provided for directing separate streams of air across the condenser and evaporator assemblies. Numbering the spirals from the condenser end as first, second, third and fourth, and considering the rotation of the shaft clockwise as seen from the condenser end, the first spiral expands outwardly from the shaft in a counterclockwise direction. The second spiral expands outwardly from the shaft in a clockwise direction. The third expands in a counterclockwise direction, and the fourth expands in a clockwise direction. The shaft is hollow and the small ends of the first and fourth spirals are connected through the hollow shaft. The small ends of the second and third spirals are connected by a capillary tube which is used to provide a pressure drop in the flow of liquid refrigerant from the second to the third spirals. The outer ends of the first and second spirals are connected together and the outer ends of the third and fourth spirals are connected together and the tubing system is filled with refrigerant.

7 Claims, 6 Drawing Figures

CENTRIFUGAL REFRIGERATION UNIT

BACKGROUND OF THE INVENTION

This invention lies in the field of refrigerating systems. More particularly, it concerns a self-contained sealed refrigerating system which does not require a conventional type of compressor. The compressing, condensing, expanding, and evaporating actions take place within the closed circuit of a plurality of spiral tubing systems.

This centrifugal refrigerating unit is designed to eliminate the piston and rotary type compressors from the refrigerating cycle. By doing so, it is possible to remove the usual problems caused by these types of compressors and their moving parts, along with the added problems created by the heat introduced into the system, by the heat of compression and wattage of the motor windings found in the hermetic type compressors. Oil is also eliminated. Dryers are also eliminated provided that the dehydration of the system is at a high vacuum of at least 500 microns. The elimination of heat, other than lead, and moisture, sludge causing oil, and moving parts, almost completely eliminates acids that cause the majority of the typical refrigeration unit problems.

SUMMARY OF THE INVENTION

It is a primary object of this invention to provide a simple apparatus for carrying out a refrigeration operation without the necessity for compressors and other moving systems. It is a further object of this invention to provide a refrigerating system in which the evaporation, compression, and condensation actions are carried out in a single closed loop of tubing, wound in a form of four spirals which are attached two at each end of a rotating hollow shaft. The only moving part is this rotating shaft, which also carries fan blades, etc. for directing air movement across the spiral tubes to carry heat away from the evaporator spirals and to carry heat away from the air flowing over the evaporator spirals.

These and other objects are realized and the limitations of the prior art are overcome in this invention by providing a simple rotating apparatus comprising a shaft and bearings with two sets of spiral tubing mounted, one set at each end of the shaft. Means are provided for directing separate air streams across the separate sets of spirals. The tubing system is filled with refrigerant. At the condenser end a suction is created for carrying the gaseous refrigerant into the first coil, in the condenser, where it is driven outwardly through the spiral by means of centrifugal force. At the outer end it connects to the second spiral and the cooling air flowing over the spiral tubes causes condensation of the gaseous refrigerant to a liquid which is pumped down into the second spiral toward the center where it flows through a capillary tube to the third spiral. The drop in pressure through the capillary causes the liquid to evaporate and to draw heat from the second stream of air flowing over the third and fourth spirals. The liquid in the third spiral is thrown outwardly by centrifugal force which causes its flow to the outer end of the spiral where it connects to the outer end of the fourth spiral and continues to flow through the spiral back to the center, continually changing from liquid to gas as further heat is extracted from the air stream flowing over the evaporator end. The gaseous refrigerant then passes through the hollow shaft back to the first spiral.

BRIEF DESCRIPTION OF THE DRAWINGS

These and other objects and advantages of this invention and a better understanding of the principles and details of this invention will be evident from the following description taken in conjunction with the appended drawings in which.

DESCRIPTION OF THE PREFERRED EMBODIMENT

Figure 1:
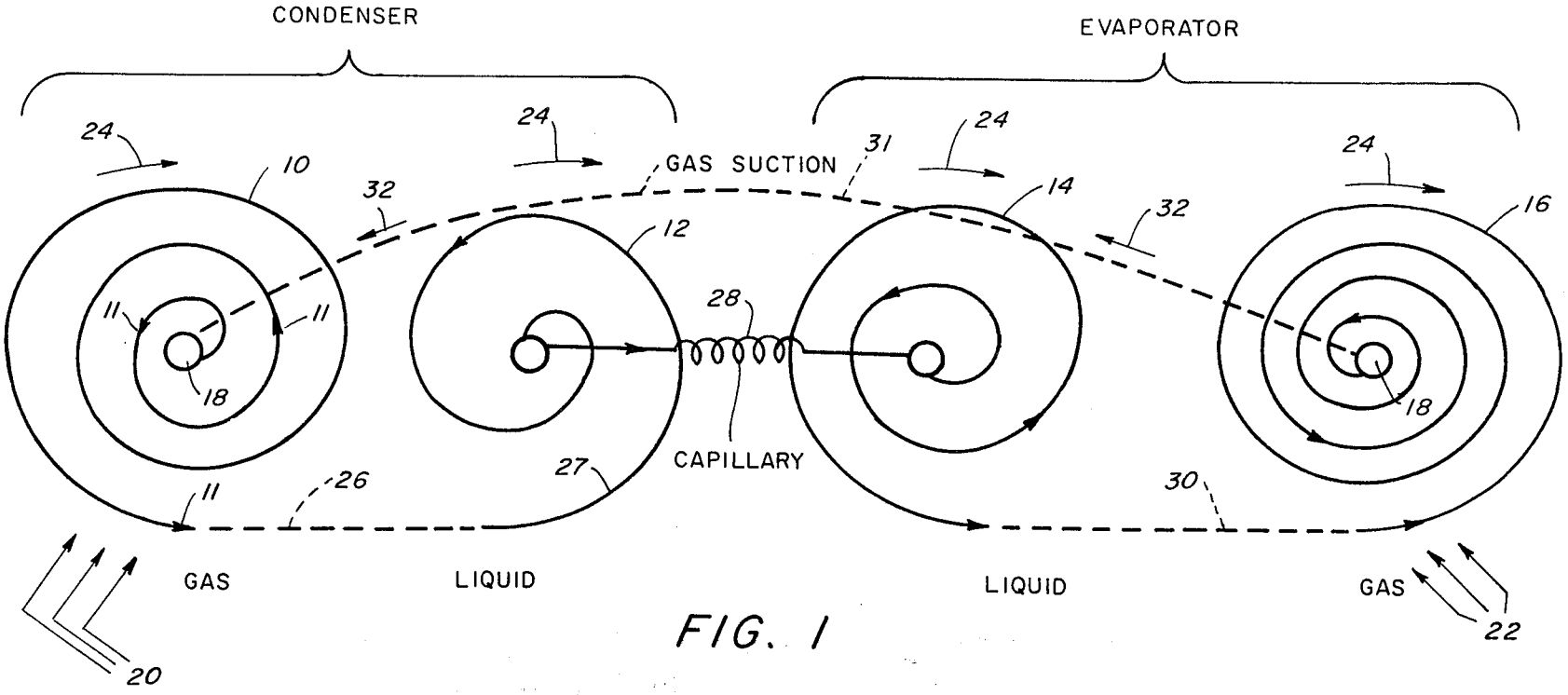
FIG. 1 shows in schematic form the four spiral tubes and their inter connections.

Referring now to the drawings and in particular to FIG. 1, there is shown in schematic form four spirals numbered 10, 12, 14 and 16. The first spiral 10 starts at a central shaft 18 and expands in a counterclockwise direction to an outer end. The second spiral expands in a clockwise direction from the center shaft to an outer end of equal radius to that of spiral 10. There are more turns in the spiral 10 than in the spiral 12, the number of turns in said spiral 12 preferably in the range of 1 to 3 turns, with a preferred number of 1½ turns. Spiral 14 again expands in a counterclockwise direction and spiral 16 in a clockwise direction. The number of turns in the spiral 16 is greater than in the spiral 14. Spirals 10 and 12 are mounted in parallel planes close together and perpendicular to, at one end of a rotating hollow shaft 18. The spirals 14 and 16 are spaced closely together at the other end of, in planes perpendicular to, the rotating shaft 18. The spirals 10 and 12 comprise the condenser section of the refrigerating unit, while the spirals 14 and 16 comprise the evaporator section. The inner ends of the spirals 10 and 16 are connected to the hollow interior of shaft 18, while the inner ends of the spirals 12 and 14 are connected together through a capillary tube 28. Air flow is schematically shown by the arrows 20 flowing over the condenser section and arrows 22 showing air flowing over the evaporator section. The air 22 is the load air and will be cooled by flowing over the evaporator while the air 20 flowing over the condenser will be heated to cool the refrigerant and to cause it to be condensed.

While the four spirals are shown spaced apart, that is for the convenience of understanding the directions in which the spirals are wound. Actually they are positioned coaxially along the hollow shaft. The arrows 24 indicate that the rotation of the shaft with the attached spirals is in a clockwise direction looking from the condenser end. The system can be designed for rotation in either direction, however, for purposes of explanation, it will be considered rotating in a clockwise direction looking at the condenser end.

Starting at the shaft 18 the first spiral 10 expands in a counterclockwise direction. The second spiral 12 expands in a clockwise direction and has fewer turns than the spiral 10. The spiral 14 expands in a counterclockwise direction and the spiral 16 expands in a clockwise direction and has more turns than the spiral 14. The outer ends of the spirals 10 and 12 are connected together and the outer ends of the spirals 14 and 16 are connected together making a complete closed loop tubular system.

Considering the rotation of the shaft and the direction of the spiral 10 there will be a flow of gas from the shaft outwardly in the spiral as shown by the arrowheads on the spiral 10. This, the first spiral 10 acts as a pump to cause gas to flow outwardly through the spiral and through the connection 26 and into the second spiral 12. Although the second spiral is wound in a different direction starting from the shaft it will be seen that the refrigerant gas flow from shaft 18 of spiral 10 is in a counterclockwise direction and continues in a counterclockwise direction to flow back to the center of spiral 12. The gas flowing through the spiral 10 is cooled by the air flow 20 and condenses to a liquid which is pumped down the spiral 12 from the outer end to the center, on the basis of the rotation of the spiral and the inertia of the liquid.

Consider a slug of liquid refrigerant at the point 27 in the second spiral 12. As the spiral turns the liquid tends to stay stationary because of its inertia, so that it slides along the spiral and moves toward the central axis 18. This acts as a compressor, creating a pressure in the liquid. The liquid passes from the second spiral 12 through a capillary tubing 28 to the third spiral 14 which is the beginning of the evaporator section.

The drop in pressure through the capillary causes the liquid to evaporate because of the different pressure-temperature conditions, and in evaporating it is cooled so that when the air flow 22 in the evaporating section flows over the coils 14 and 16, it will be cooled. Giving up heat from the air 22 causes additional evaporation of the liquid refrigerant which flows from the spiral coil 14 into the spiral coil 16. The additional surface area of coil 16 adds to the heat transfer from the air 22, until all of the liquid refrigerant is evaporated by the time it reaches the shaft 18. The gaseous refrigerant then flows along the gas suction line 31, which is the hollow conduit of the rotating shaft, the gaseous refrigerant flowing in accordance with the arrows 32 back to the axis end of the spiral 10.

The flows of refrigerant through the system are caused by the centrifugal action in the rotating spirals 10 and 14 and by the inertial action of the liquid refrigerant in the spiral coil 12.

Figure 2:
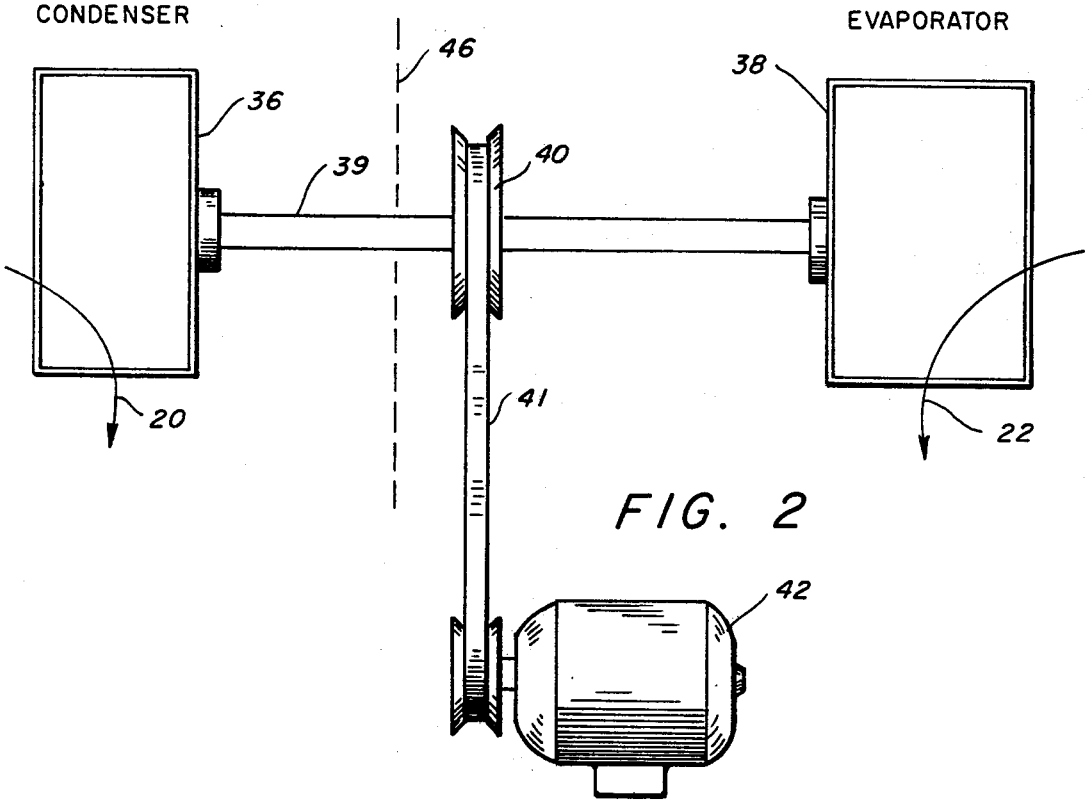
FIG. 2 shows the overall layout of the apparatus.

Referring now to FIG. 2, there is shown an over-all view of one embodiment of this invention, which provides the shaft 39 running in bearings, not shown but well-known in the art. The shaft 39 is driven by pulley 40, belt 41 and motor 42. At the first end of the shaft 39 is the condenser section 36 and at the opposite end of the shaft, the evaporator section 38. As will be explained in connection with FIGS. 5A and 5B, the rotating assemblies 36 and 38 have built-in fan-blades, to cause air flow through the housings 36 and 38 in accordance with arrows 20 and 22. Thus, there will be heat transfer between the flowing air and the spiral coils in each of the housing. Normally there would be a wall dividing the air spaces around the condenser and the evaporator, as suggested by the dashed line 46, for example. The air flow 20 would be outdoor air flowing through the condenser, whereas the air flow 22 would room air flowing through the evaporator section. The shaft 39 could actually extend through the wall, or ducts could be provided from outside of the wall to flow through 20, while the room air 22 flows through the other assembly. The four sets of coils, 2 in the housing 36 and 2 in the housing 38, comprise the complete self-contained system. There is no separation of compressors, condensers and evaporators as in the conventional system.

Since there is no separate compressor, there is no need for oil in the refrigerant. Thus there can be a better refrigerant used, such as R 12 Freon. Also there is less corrosion and in addition, there is no heat from the motor that would be driving the compressor to the dissipated.

Figure 3:
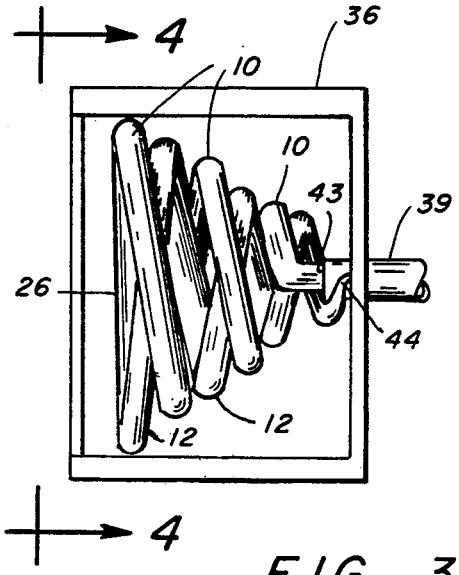
FIGS. 3 and 4 show one form of a double spiral unit.

Referring to FIG. 3 there is shown one possible way in which to build the multiple spiral coils. The assembly shown in FIG. 3 comprises a first expanding coil 10 which is attached to the shaft 39 at point 43. This would be coil 10 and it expands outward in a helical spiral to a maximum diameter at the point 26, which is the joint between the expanding spiral and a contracting spiral 12, which ends up at the point 44, which is the beginning of the capillary 28.

Figure 4:
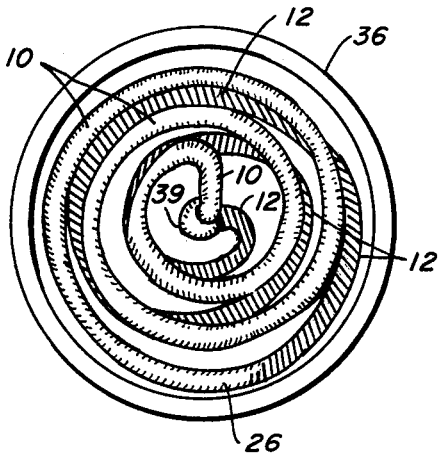
Figure 5B:
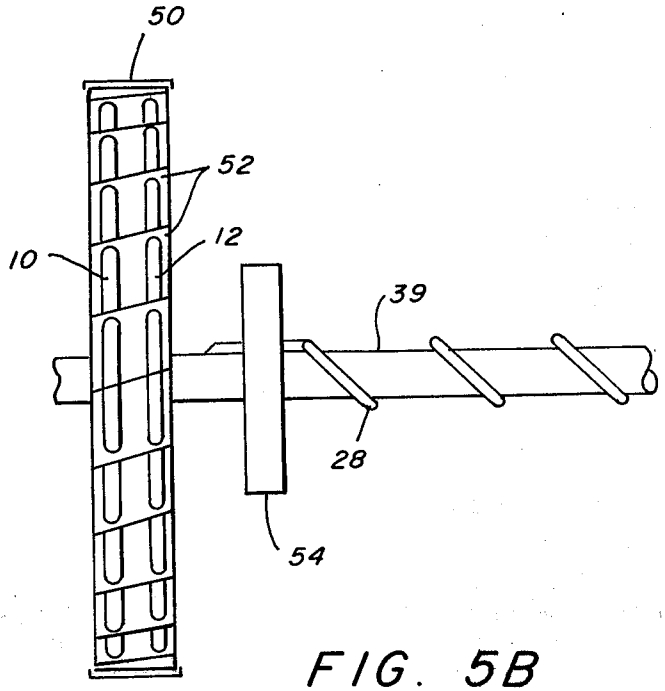
FIGS. 5A and 5B show two views of one pair of spirals and a fan blade structure for carrying an air flow across the spiral tubes.
Figure 5A:
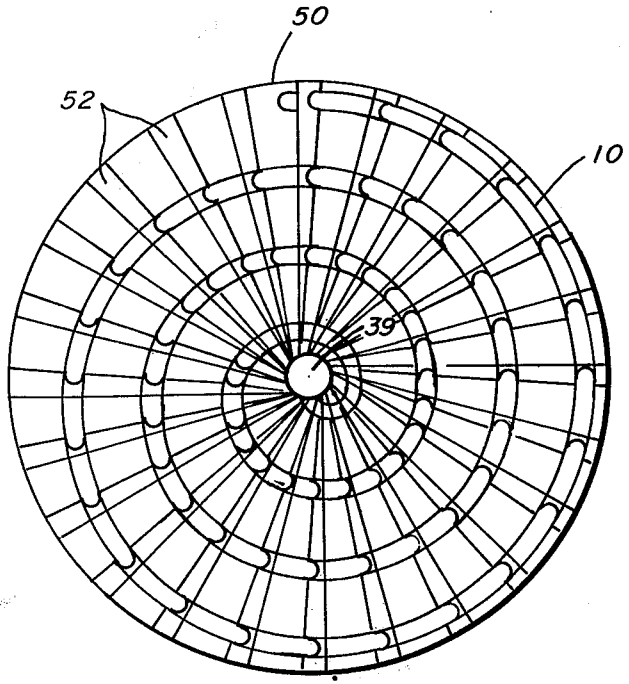

In FIG. 4 is shown a view across the plane 4—4 of FIG. 3. The two coils are shown. The expanding coil 10 starts at the shaft 39 and expands in a counter-clockwise direction, out to the point 26. The portion comprising the spiral 12 is shown in cross-hatched form. It will be clear that longitudinal vanes can be mounted on the perimeter of the housings 36, 38 to form a blower for flowing air over the spiral coils. In FIGS. 5A and 5B will be shown a second manner of winding these coils.

Referring now to FIGS. 5A and 5B, there is shown another form in which the spiral coils can be constructed. There is an outer cylindrical portion 50 of strip metal, with a plurality of radial spokes or strips, which are turned at an angle so as to form blades, so that by the rotation of the shaft air will be caused to flow across the coils 10 and 12. Here the two coils are side by side, co-planar and perpendicular to the shaft 39, they are supported by the radial strips 52 which comprise the fan blades. Shown in FIG. 5B is the hollow shaft 39 which serves to conduct gaseous refrigerant from the coil 16 to the coil 10. Numeral 54 indicates a bearing for the support of the shaft, and 28 represents the capillary tubing which can be wrapped around the shaft within the inner hub of the bearing, or it can be laid in a groove along the surface of the shaft as desired.

Of course other forms of tubing coils can be employed, and the blades 52 can be in the form of radial blades as in a fan, or longitudinal bales, as in a blower, as might be used in FIGS. 2, 3 and 4.

It will be clear that spirals 10 and 16 are substantially mirror images of each other. While not shown in the drawings, they could be identical in turns, etc. Similarly the spirals 12 and 14 are substantially mirror images of each other. Therefore, by rotating the shaft in the opposite direction, and observing the operation from the other end of the shaft, the spirals 14, 16 now become the condenser section and spirals 10, 12 become the evaporator section.

Although the term "motor" is used herein, that term is to be inclusive of other power sources including but not limited to internal combustion engines, turbines, etc.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. A centrifugal refrigeration unit comprising:

a. a hollow shaft having a first and second ends supported in bearings, and motor means to rotate said shaft in a given direction;

b. a condenser, comprising first and second metal tubing spirals mounted on a first end of said shaft, the first spiral spiraling outwardly from said shaft in a direction counter to said direction of shaft rotation, the second spiral spiraling outwardly from said shaft in the same direction as said shaft rotation, said first spiral having more turns than said second spiral;

c. an evaporator, comprising third and fourth metal tubing spirals mounted at the second end of said shaft, the third spiral spiraling outwardly in the opposite direction of shaft rotation, the fourth spiral spiraling outward in the same direction of shaft rotation said fourth spiral having more turns than said third spiral;

d. said first and fourth spirals in fluid communication at their inner ends to opposite ends of said hollow shaft, the second and third spirals connected and in fluid communication at their inner ends to opposite ends of a capillary tube, said first and second spirals connected together at their outer ends, said third and fourth spirals connected together at their outer ends; and e. means to fill the tubing system with refrigerant.

2. The unit as in claim 1 in which said spirals are planar, and mounted parallel to each other and perpendicular to said shaft.

3. The unit as in claim 1 in which said spirals are helical spirals.

4. The unit as in claim 1 including means in combination with said spirals and rotation of said shaft to cause separate air flows over each pair of spirals.

5. The unit as in claim 4 in which said means comprises fan-blades support said spiral.

6. The unit as in claim 4 in which said means comprise blower vanes.

7. A centrifugal refrigeration unit comprising:

a. a hollow shaft having a first and second ends supported in bearings, and motor means to rotate said shaft in a given direction;

b. a condenser, comprising first and second metal tubing spirals mounted on a first end of said shaft, the first spiral spiraling outwardly from said shaft in a direction counter to said direction of shaft rotation, the second spiral spiraling outwardly from said shaft in the same direction as said shaft rotation;

c. an evaporator, comprising third and fourth metal tubing spirals mounted at the second end of said shaft, the third spiral spiraling outwardly in the opposite direction of shaft rotation, the fourth spiral spiraling outwardly in the same direction of shaft rotation;

d. said first and fourth spirals in fluid communication at their inner ends to opposite ends of said hollow shaft, the second and third spirals connected and in fluid communication at their inner ends to opposite ends of a capillary tube, said first and second spirals connected together at their outer ends, said third and fourth spirals connected together at their outer ends; and e. means to fill the tubing system with refrigerant.

* * * * *